US009272201B2

(12) United States Patent
Ormsby

(10) Patent No.: US 9,272,201 B2
(45) Date of Patent: Mar. 1, 2016

(54) FOOTBALL FAN OFFICIATING SYSTEM

(71) Applicant: Garry Ormsby, Harwich, MA (US)

(72) Inventor: Garry Ormsby, Harwich, MA (US)

( * ) Notice: Subject to any disclaimer, the term of this patent is extended or adjusted under 35 U.S.C. 154(b) by 57 days.

(21) Appl. No.: 14/288,120

(22) Filed: May 27, 2014

(65) Prior Publication Data

US 2014/0353184 A1 Dec. 4, 2014

Related U.S. Application Data

(60) Provisional application No. 61/829,126, filed on May 30, 2013.

(51) Int. Cl.

| | |
|---|---|
| ***A63B 67/06*** | (2006.01) |
| ***A63F 3/00*** | (2006.01) |
| ***A63F 9/02*** | (2006.01) |
| *B65D 81/36* | (2006.01) |
| *A63F 11/00* | (2006.01) |

(52) U.S. Cl.

CPC ..... *A63F 3/00041* (2013.01); *A63F 9/02* (2013.01); *A63B 67/06* (2013.01); *A63F 2011/0097* (2013.01); *B65D 81/36* (2013.01); *B65D 81/365* (2013.01)

(58) Field of Classification Search

CPC ..... B65D 81/36; B65D 81/365; A63B 67/06

USPC ..... 473/415; 273/348, 398–402; 206/216, 206/223, 232, 457; D7/606

See application file for complete search history.

(56) References Cited

U.S. PATENT DOCUMENTS

| | | | | |
|---|---|---|---|---|
| 2,385,878 | A | 10/1945 | Nicolelo | |
| 3,624,939 | A * | 12/1971 | Gossard | A47G 1/12 206/0.84 |
| 4,164,284 | A * | 8/1979 | Witt | B65D 81/3846 206/217 |
| 4,541,013 | A | 9/1985 | Alpert | |
| D308,320 | S * | 6/1990 | Raucci | 206/457 |
| 5,450,979 | A * | 9/1995 | Servick | B65D 81/365 206/217 |
| 6,041,918 | A * | 3/2000 | Moore | B65D 7/04 206/0.815 |
| 6,149,955 | A * | 11/2000 | Wilson | B65D 23/085 206/0.8 |
| D565,288 | S * | 4/2008 | Hickman | D3/201 |
| D578,585 | S | 10/2008 | Bramble et al. | |
| 7,871,304 | B2 | 1/2011 | Lovato | |
| 8,197,318 | B2 | 6/2012 | Miles | |
| 8,684,397 | B2 * | 4/2014 | Blakeman | A45C 5/08 280/30 |
| D714,868 | S * | 10/2014 | Nash | D19/86 |
| D724,902 | S * | 3/2015 | Dickerson | D7/625 |
| 2003/0201201 | A1 * | 10/2003 | Cheng | B65D 81/365 206/457 |
| 2006/0118448 | A1 * | 6/2006 | Fanning | G09F 19/08 206/457 |
| 2006/0217027 | A1 | 9/2006 | Martuccio | |
| 2013/0109513 | A1 * | 5/2013 | Fernandez | A63B 67/06 473/585 |
| 2014/0091525 | A1 * | 4/2014 | Ramirez | A63B 63/08 273/402 |

* cited by examiner

*Primary Examiner* — Mark Graham

(74) *Attorney, Agent, or Firm* — RG Patent Consulting, LLC; Rachel Gilboy

(57) ABSTRACT

A sports novelty to help football fans increase their enjoyment of watching televised professional football games. The football fan officiating system is a hollow football containing football penalty flags and game instructions comprising football rules and regulations allow users to view a football game and use the penalty flags to call a penalty on one or more players during play of the game.

19 Claims, 5 Drawing Sheets

FOOTBALL FAN OFFICIATING SYSTEM

CROSS-REFERENCE TO RELATED APPLICATION

The present application is related to and claims priority from prior provisional application Ser. No. 61/829,126, filed May 30, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of sports novelty devices and more specifically relates to a football fan officiating system.

DESCRIPTION OF THE RELATED ART

The National Football League (NFL) is a professional American football league that constitutes one of the four major professional sports leagues in North America. The NFL was formed on Aug. 20, 1920 as the American Professional Football conference; the league changed its name to the American Professional Football Association on Sep. 17, 1920 and then changed its name to the National Football League on Jun. 24, 1922.

In 1966 the NFL agreed to merge with the rival American Football League (AFL) with two conferences, the National Football Conference (NFC) and the American Football Conference (AFC). The first Super Bowl was held following the 1966 season. Today, the NFL has the highest average attendance of any professional sports league in the world and is the most popular sports league in the United States. The game has become so popular that football games are televised every Sunday, Monday, and Thursday during the NFL season. It has become so popular that a new television network (the NFL network) was launched Nov. 4, 2003. The NFL is now composed of 32 teams divided equally between the NFC and the AFC. The NFL runs a 17-week regular season from the week after Labor Day to the week after Christmas, with each team playing sixteen games and having one by week each season. Out of the league's 32 teams, six teams from each conference compete in the NFL playoffs, a single-elimination tournament culminating in the Super Bowl played between the champions of the NFC and the AFC. The NFL, by far, has become the most popular spectator sport in the United States.

With the growth and immense popularity of the NFL several changes have occurred within American society including the advent of "fantasy football", televised games in sports bars and even special programming offered by television cable companies to include special "packages" to show every touchdown and even every full game. With this popularity, many football fans gather in homes to have a weekly social event and often spend time questioning the plays called by the team's head coaches as well as the penalty calls (or lack of penalty calls) made by game officials.

The televisions networks have been able to replay questionable plays over and over again allowing the homebound football fans see when good calls and bad calls have been made. In fact, many of these fans wish they could officiate a game, but there hasn't been anything available giving them that opportunity. Many of these fans want to call penalties during the game and defend their actions based on current NFL rules and regulations. They want to be more than just spectators; they want to have a stake in the game. Obviously, the penalty calls they make or don't make won't affect the outcome of the game itself, but these calls will greatly enhance the enjoyment of watching a football game at home on a television set.

Various attempts have been made to solve the above-mentioned problems such as those found in U.S. Pub. No. 2006/0217027 to Michael Martuccio, U.S. Pat. No. D578,585 to Christopher Bramble, et. al., U.S. Pat. No. 4,541,013 to Sidney A. Alpert, U.S. Pat. No. 2,385,878 to Louis L. D. Nicolello, U.S. Pat. No. 8,197,318 to Miles Jacques, and U.S. Pat. No. 7,871,304 to Anthony R. Lovato. This art is representative of sports novelty devices. None of the above inventions and patents, taken either singly or in combination, is seen to describe the invention as claimed.

Ideally, a football fan officiating system should provide football fans watching a football game at home with the ability to call pseudo penalties on players violating official rules and regulations, and thus, enhance their viewing of the game and, yet would operate reliably and be manufactured at a modest expense. Thus, a need exists for a reliable football fan officiating system for enjoyment and to avoid the above-mentioned problems.

BRIEF SUMMARY OF THE INVENTION

In view of the foregoing disadvantages inherent in the known sports novelty art, the present invention provides a novel football fan officiating system. The general purpose of the present invention, which will be described subsequently in greater detail is to provide a football game experience for fans watching a game on a television. When the fans see a rule violation as described in an included official football rules and regulations booklet by one or more of the football players, they can retrieve a penalty flag from a hollow facsimile football resting close to them and toss the flag to the floor and announce what the penalty was and which player(s) committed the penalty. This active watching of the football game increases the viewing enjoyment for the users.

A football fan officiating system is disclosed herein, in a preferred embodiment, comprising: a football-fan-officiating-assembly and associated game-instructions. The football-fan-officiating-assembly comprises in combination a flag-container having a top-half and a bottom-half, a plurality-of-flags, and a holding-tee.

The flag-container having a top-half and a bottom-half preferably comprises light-weight plastic material for durability in use. The top-half comprises a bottom-edge able to be removably fitted into a top-edge of the bottom-half comprising a coupling with a smooth surface. The flag-container comprises a full-volume when the top-half and the bottom-half are fitted together and comprise a complete-football when assembled. The complete-football having stitching and simulated-football-lacing on an outside-surface and indicia of one of various professional football teams is hollow and able to concealably contain the plurality-of-flags when not in use. The complete-football is able to be separated into the top-half and the bottom-half when in use, with the bottom-half holding the plurality-of-flags. The bottom-half is structured and arranged to be able to rest on the holding-tee when in use with users able to access the plurality-of-flags while viewing a football-game.

The plurality-of-flags comprises a sufficient quantity of flags to be used by at least two users for the duration of the football-game. Each of the plurality-of-flags comprises a shape of a badminton shuttlecock having a rounded-end and wings. Each of the plurality-of-flags further comprise thin material able to aerodynamically slice through air as it is thrown and each of the rounded-ends comprises wadding to provide weight allowing each of the plurality-of-flags to be tossed by a user to a planer-surface comprising a floor.

The holding-tee made of light-weight plastic material for stability during use comprises a flat hollow square able to hold the tip of the bottom-half of flag-container. The holding-tee further comprises a leg at each corner of the flat-hollow-square with the legs able to hold the flat-hollow-square above a planer-surface comprising a table or desk or the like.

The game-instructions comprise a booklet describing the officiating duties for a professional football official and professional football regulations and is able to be stored within the flag-container resembling a football when not in use. The booklet of game-instructions is removed from the bottom-half when in use and is available for the users for the duration of the football-game.

The users are able to watch a football-game and when users see an infraction according to the game-instructions for the duration of the football-game, the users are able to retrieve one of the plurality-of-flags from the bottom-half and toss one of the plurality-of-flags to a planer-surface comprising a floor to indicate that the user is calling a penalty on at least one of the players participating in the football-game. The user then is able to announce the penalty and cite the regulation from the game-instructions. When the game officials announce the penalty, the user's penalty call is able to be confirmed or not confirmed.

The present invention holds significant improvements and serves as a football fan officiating system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, football fan officiating system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a sports novelty and more particularly to a football fan officiating system as used to improve the viewing experience for football fans by giving them an opportunity to call penalties on one or more football players for the duration of the game being viewed.

Generally speaking, a football fan officiating system comprises a hollow football containing football penalty flags and game instructions for professional officials and football rules and regulations defined the rules used by professional football teams during play. As users are viewing a football game at home on their television sets, they can use the penalty flags to call a penalty on one or more players during play of the game (yet not affecting the actual game). By using the rules and regulations they can explain the penalty to other users. The user's call will be confirmed or not confirmed by the game officials working the football game when the penalty is announced on the field.

Figure 1:
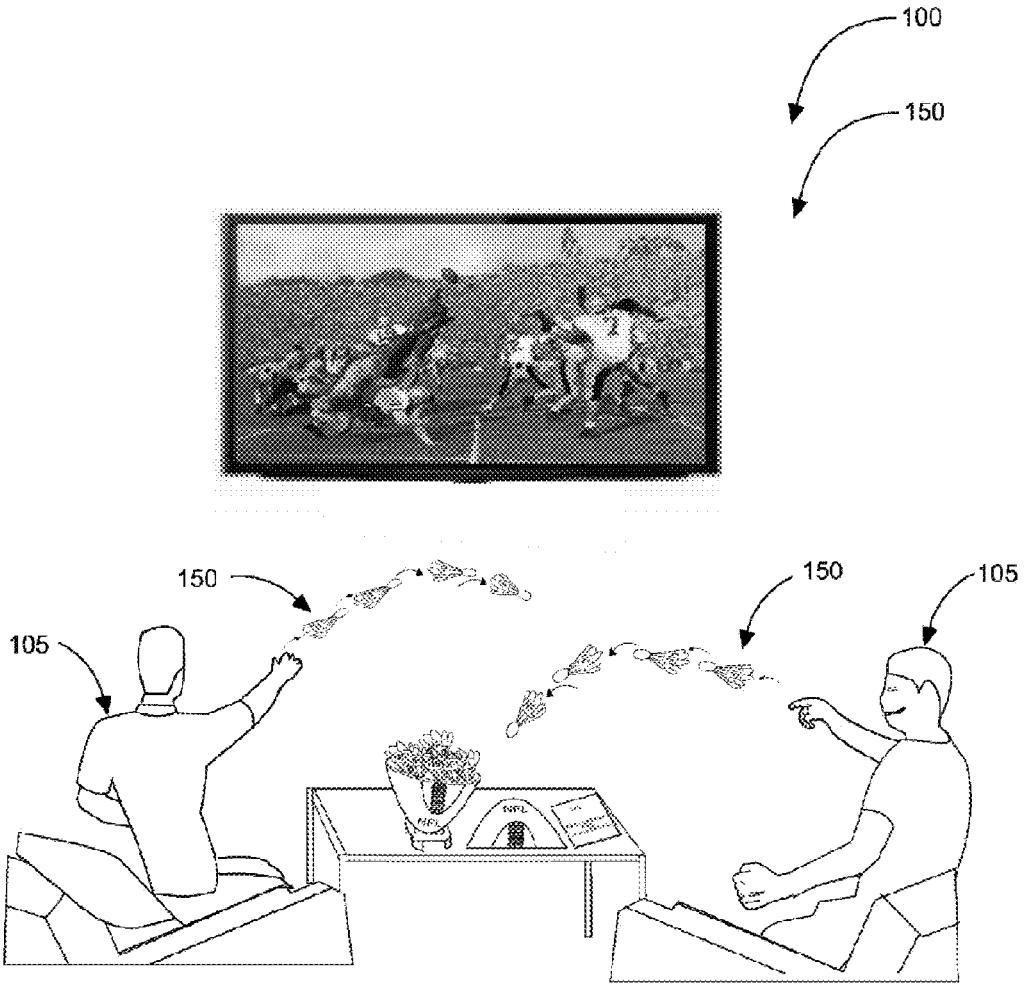
FIG. 1 shows a perspective view illustrating a football fan officiating system in an in-use condition according to an embodiment of the present invention.

Referring to the drawings by numerals of reference there is shown in FIG. 1, a perspective view illustrating football fan officiating system 100 in an in-use condition 102 according to an embodiment of the present invention.

Football fan officiating system 100 comprises football-fan-officiating-assembly 110 and associated game-instructions 180. Football-fan-officiating-assembly 110 comprises in combination flag-container 120 having top-half 130 and bottom-half 140, plurality-of-flags 150, and holding-tee 160.

Users 105 are able to watch a football-game, and when users 105 see an infraction according to game-instructions 180 for the duration of the football-game, users 105 are able to retrieve one of plurality-of-flags 150 from bottom-half 140 and toss one of plurality-of-flags 150 to a planer-surface comprising a floor to indicate that user 105 is calling a penalty on at least one of the players participating in the football-game. Users 105 may view the football game at any location, in a home, a recreation center, or other places, therefore the planer-surface may comprise any suitable surface user 105 may wish to toss one of plurality-of-flags 150 to. After tossing one of plurality-of-flags 150 user 105 then is able to announce the penalty and cite the regulation from game-instructions 180. When the game officials announce the penalty, user's 105 penalty call is able to be confirmed or not confirmed.

Figure 2:
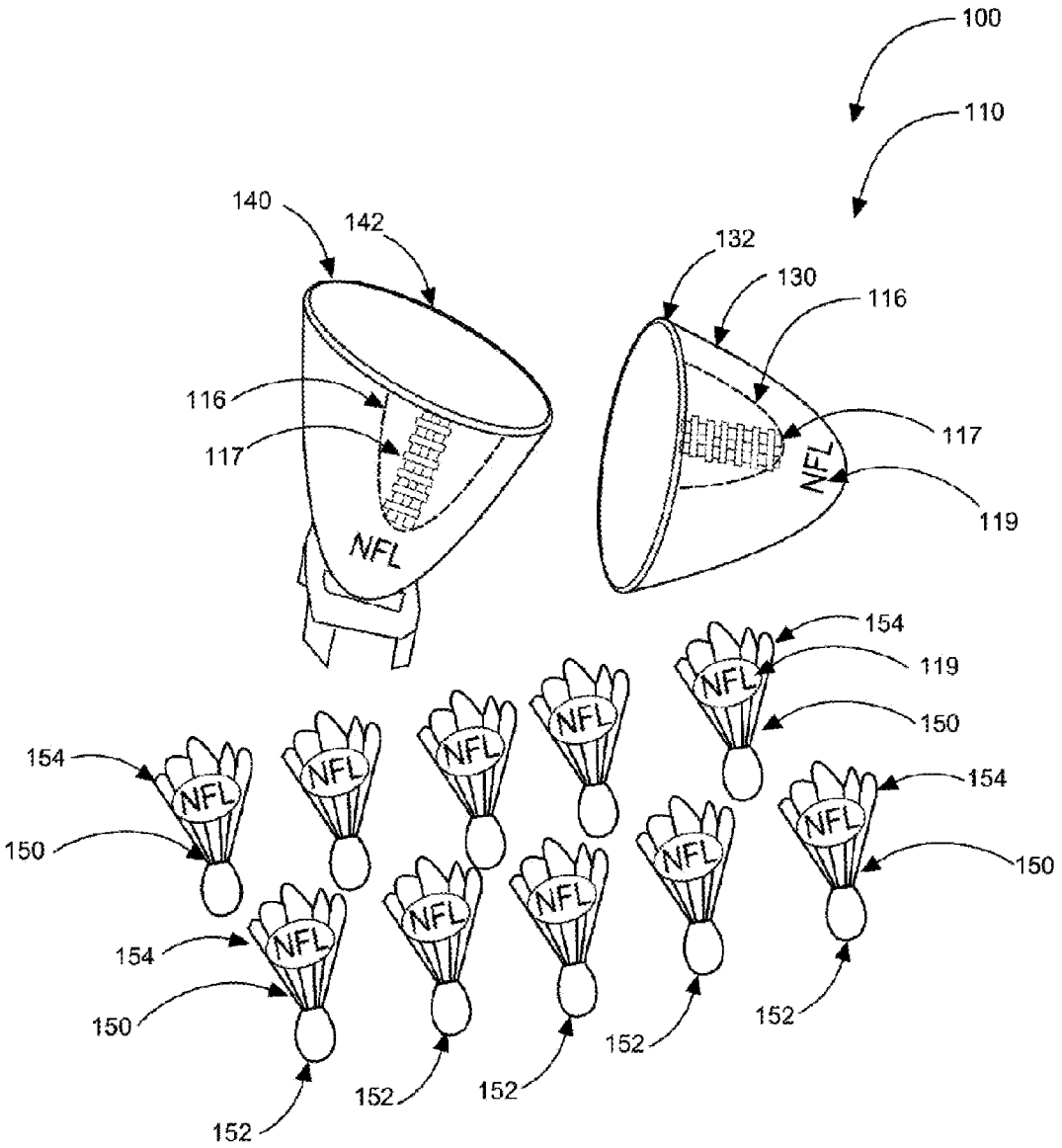
FIG. 2 is a perspective view illustrating components of a football fan officiating system according to an embodiment of the present invention of FIG. 1.

Referring now to FIG. 2, a perspective view illustrating various components of football fan officiating system 100 according to an embodiment of the present invention of FIG. 1.

Flag-container 120 having top-half 130 and bottom-half 140 comprises light-weight plastic material for durability in use. Other suitable materials may also be used for flag-container 120 in alternate embodiments. Flag-container 120 is preferably the size of an NFL regulation size football. Alternate embodiments may include flag-container 120 of any size as desired. Top-half 130 comprises bottom-edge 132 able to be removably fitted into top-edge 142 of bottom-half 140 comprising a coupling with a smooth surface. Bottom-edge 132 comprises an extension able to fit into top-edge 142 comprising an indentation in bottom-half 140. When coupled together top-half 130 and bottom-half 140 are held securely in place.

Flag-container 120 comprises a full-volume when top-half 130 and bottom-half 140 are fitted together and comprise a structured and arranged complete-football 115 when assembled. Complete-football 115 having simulated stitching 116 and simulated-football-lacing 117 on outside-surface 118 and indicia 119 of one of various professional football teams is hollow and able to concealably contain plurality-of-flags 150 when not in use. Complete-football 115 is able to be separated into top-half 130 and bottom-half 140 when in use, with bottom-half 140 holding plurality-of-flags 150. Bottom-half 140 is structured and arranged to be able to rest on holding-tee 160 when in use with users 105 able to access plurality-of-flags 150 from bottom-half 140 while viewing a football-game.

Figure 3:
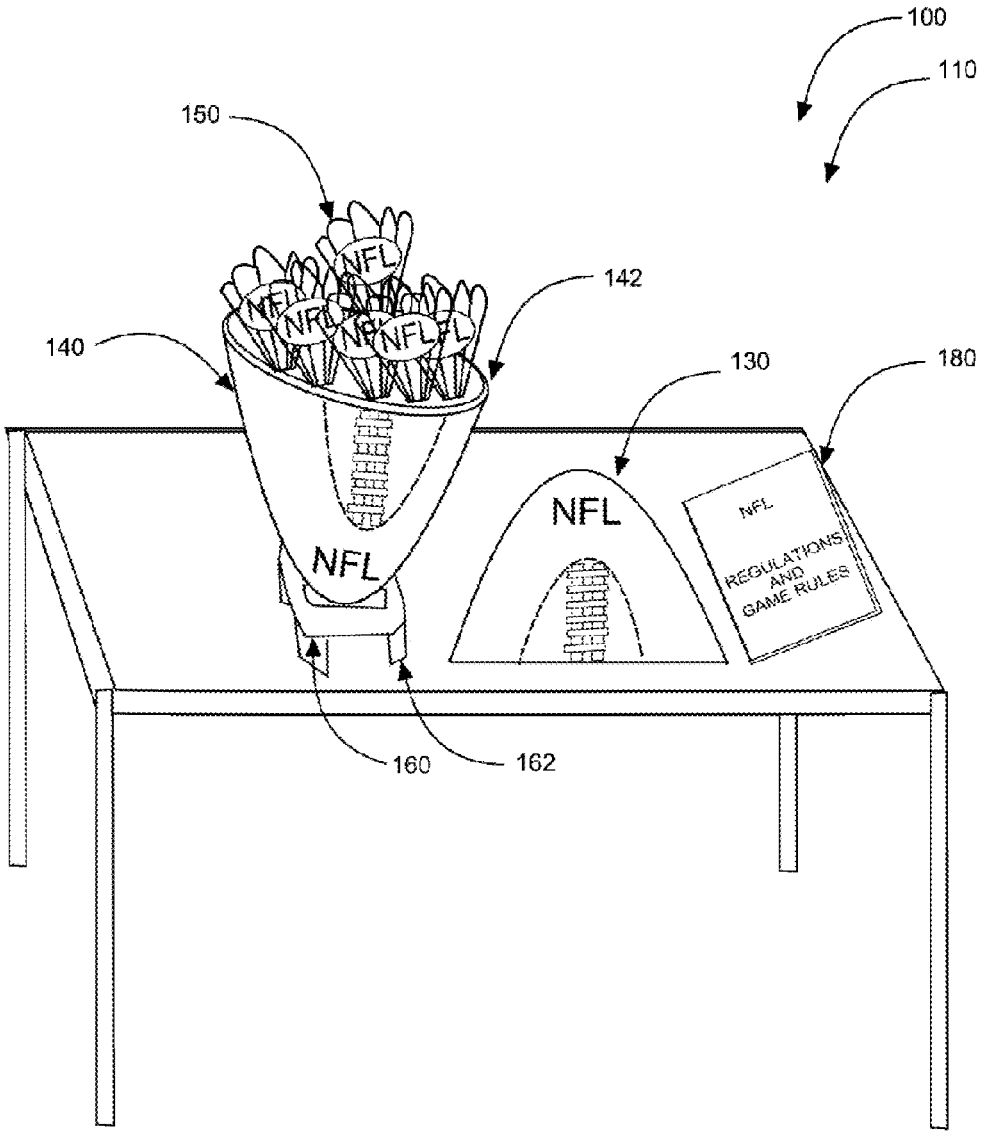
FIG. 3 is a perspective view illustrating the football fan officiating system ready for use according to an embodiment of the present invention of FIG. 1.

Referring now to FIG. 3, a perspective view illustrating football-fan-officiating-system 100 ready for use according to an embodiment of the present invention of FIG. 1.

Plurality-of-flags 150 comprises a sufficient quantity of flags 150 to be used by at least two users 105 for the duration of the football-game. A single user 105 may also wish to use football fan officiating system 100 when viewing a football game alone. Each of plurality-of-flags 150 comprises a shape of a badminton shuttlecock having rounded-end 152 and wings 154. Each of plurality-of-flags 150 further comprise thin (yet durable) material able to aerodynamically slice through air as it is thrown and each of rounded-ends 152 comprises wadding to provide weight allowing each of plurality-of-flags 150 to be tossed by user 105 to a planer-surface comprising a floor. The wadding comprises any suitable material able to be fitted within rounded-ends 152.

Game-instructions 180 comprise a booklet describing the officiating duties for a professional football official and professional football regulations, and is able to be stored within flag-container 120 when not in use. The booklet of game-instructions 180 is removed from bottom-half 140 when in use and is available for users 105 for the duration of the football-game. In alternate embodiments game-instructions 180 comprise a booklet describing the rules and regulations for different levels of football games including college level football and high-school level football.

Figure 4:
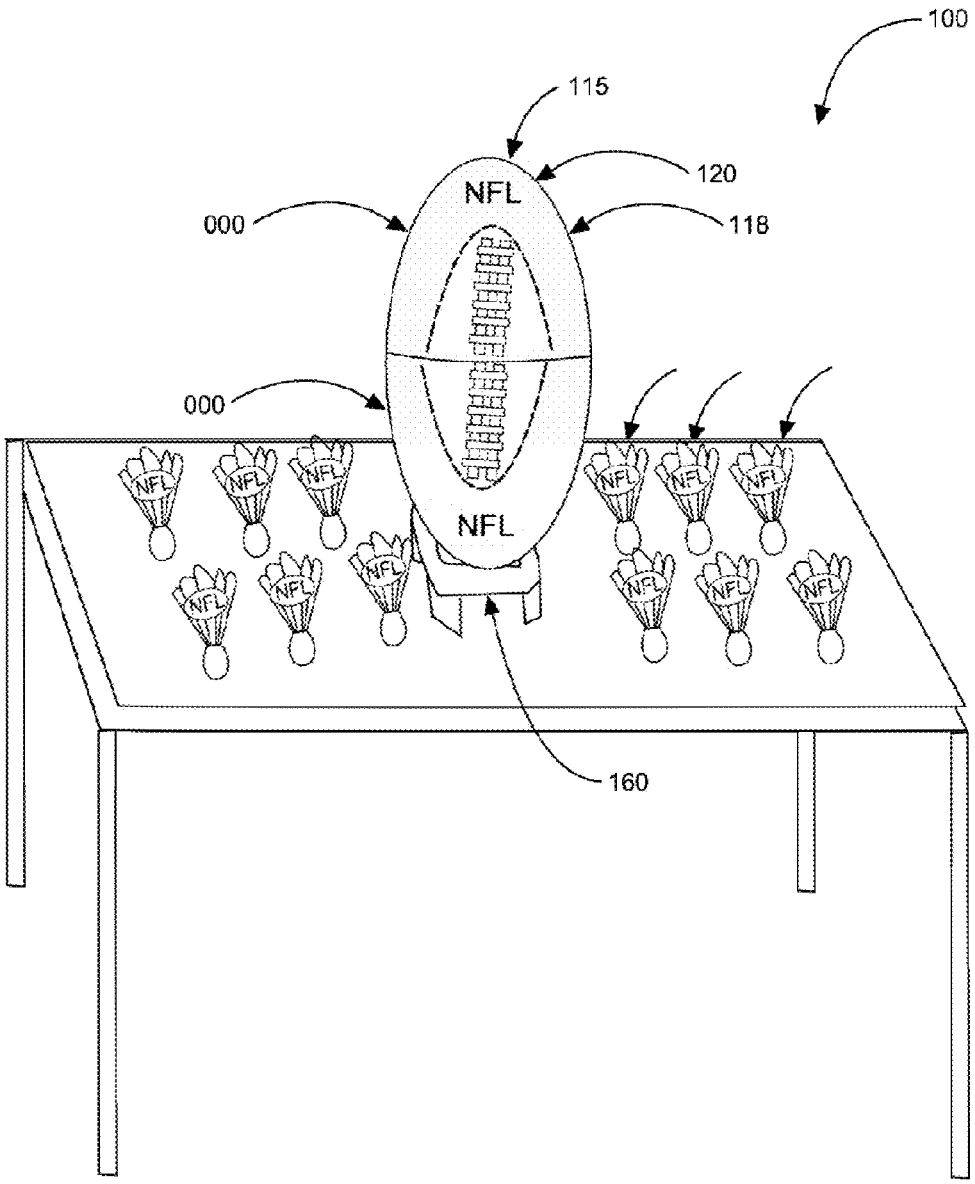
FIG. 4 is a perspective view illustrating a flag-container resting on a holding-tee according to an embodiment of the present invention of FIG. 1.

Referring now to FIG. 4 is a perspective view illustrating flag-container 120 resting on holding-tee 160 according to an embodiment of the present invention of FIG. 1.

Holding-tee 160 made of light-weight plastic material for stability during use comprises a flat hollow square able to hold the tip of bottom-half 140 of flag-container 120. Holding-tee 160 further comprises leg 162 at each corner of the flat-hollow-square with legs 162 able to hold the flat-hollow-square above a planer-surface comprising a table. In alternate embodiments holding-tee 160 may be comprised of other materials suitable to serve for holding complete-football 115.

Football fan officiating system 100 may be sold as kit 440 comprising the following parts: at least one football-fan-officiating-assembly 110 having top-half 130 and bottom-half 140; a plurality-of-flags 150; at least one holding-tee 160; at least one set of game-instructions 180; and at least one set of user instructions. The kit has instructions such that functional relationships are detailed in relation to the structure of the invention (such that the invention can be used, maintained, or the like in a preferred manner). Football fan officiating system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
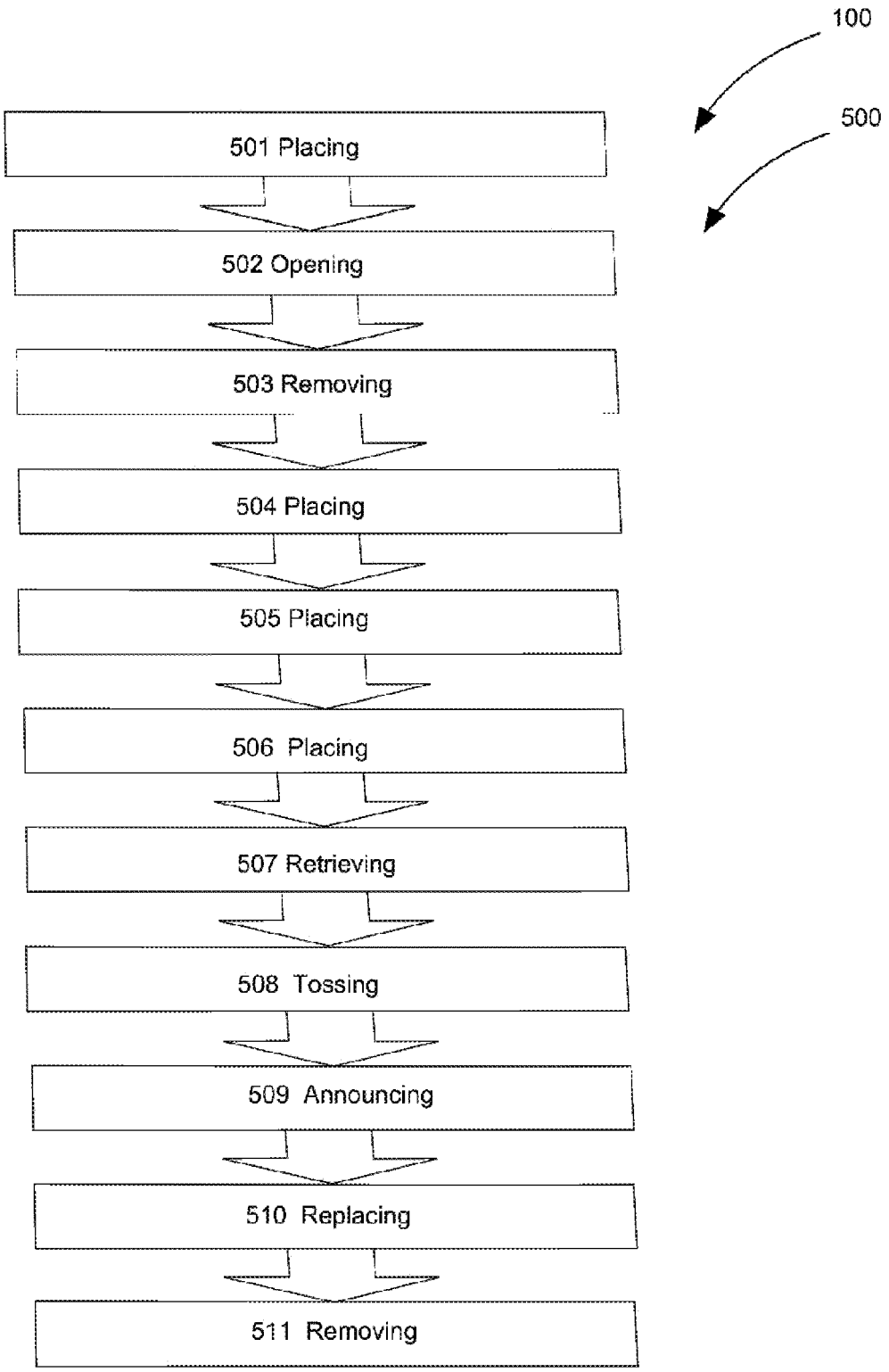
FIG. 5 is a flowchart illustrating a method of use for the football fan officiating system according to an embodiment of the present invention of FIGS. 1-4.

Referring now to FIG. 5, a flowchart illustrating a method of use 102 for football fan officiating system 100 according to an embodiment of the present invention of FIGS. 1-4.

A method of use 500 for football fan officiating system 100 may comprise the steps of: step one 501 turning on a television to watch a football game, step two 502 placing football fan officiating system 100 in a suitable location for use during said football-game, step three 503 opening complete-football 115 to separate top-half 130 and bottom-half 130, step four 504 removing game-instructions 180 from said bottom-half 140, step five 505 placing plurality-of-flags 150 into said bottom-half 140, step six 506 placing said bottom-half 140 on holding-tee 160, step seven 507 placing said top-half 130 at a suitable location until ready to join said bottom-half 140 and said top-half 130, step eight 508 retrieving one of said plurality-of-flags 150 when a penalty is detected, step nine 509 tossing one of said plurality-of-flags 150 to a planer surface, step ten 510 announcing the penalty being called, step eleven 511 replacing all used said plurality-of-flags 150 to said bottom-half 140 at completion of said football game, step twelve 512 removing said bottom-half 140 from said holding-tee 160; and step thirteen 513 rejoining said bottom-half 140 and said top-half 130 to have complete-football 115 until ready for next use.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A football fan officiating system comprising:

a football-fan-officiating-assembly comprising;

a flag-container having a top-half and a bottom-half;

a plurality-of-flags; and a holding-tee; and game-instructions;

wherein said football fan officiating system comprises said football-fan-officiating-assembly and said game-instructions;

wherein said football-fan-officiating-assembly comprises in combination said flag-container having said top-half and said bottom-half, said plurality-of-flags, and said holding-tee;

wherein said top-half and said bottom-half are able to be removably fitted together to form a structured and arranged complete-football when assembled;

wherein said complete-football is hollow and able to concealably contain said plurality-of-flags when not in use;

wherein said complete-football is able to be separated into said top-half and said-bottom when in use with said bottom-half holding said plurality-of-flags;

wherein said bottom-half is structured and arranged able to rest on said holding-tee when in use and users are able to access said plurality-of-flags while viewing a football-game;

wherein said users are able to watch said football-game; and wherein when said users see an infraction for a duration of said football-game according to said game-instructions, said users are able to retrieve one of said plurality-of-flags from said bottom-half and toss one of said plurality-of-flags to a planer-surface to indicate that said user is calling a penalty on at least one of players participating in said football-game.

2. The football fan officiating system of claim 1 wherein said flag-container having said top-half and said bottom-half comprises a full-volume when fitted together.

3. The football fan officiating system of claim 2 wherein said flag-container having said top-half and said bottom-half comprises stitching and simulated-football-lacing on an outside-surface.

4. The football fan officiating system of claim 3 wherein said flag-container having said top-half and said bottom-half comprises indicia of one of various professional football teams.

5. The football fan officiating system of claim 2 wherein said top-half comprises a bottom-edge able to be removably fitted into a top-edge of said bottom-half.

6. The football fan officiating system of claim 5 wherein when said bottom-edge and said top-edge are removably-fitted together forming a coupling, said coupling comprising a smooth-surface.

7. The football fan officiating system of claim 2 wherein said flag-container having a top-half and a bottom-half comprises light-weight plastic material for durability in use.

8. The football fan officiating system of claim 1 wherein said plurality-of-flags comprises a quantity of said plurality-of-flags sufficient to be used by at least two users for said duration of said football-game.

9. The football fan officiating system of claim 8 wherein each of said plurality-of-flags comprises a shape of a badminton shuttlecock having a rounded-end and wings.

10. The football fan officiating system of claim 9 wherein each of said plurality-of-flags comprises thin material able to aerodynamically slice through air as it is thrown.

11. The football fan officiating system of claim 10 wherein each of said rounded-ends comprises wadding to provide weight, said weight allowing said plurality-of-flags to be tossed by a user to said planer-surface comprising a floor.

12. The football fan officiating system of claim 1 wherein said holding-tee comprises a flat hollow square able to hold a tip of said bottom-half of said flag-container.

13. The football fan officiating system of claim 12 wherein said holding-tee further comprises a leg at each corner of said flat-hollow-square, said legs able to hold said flat-hollow-square above said planer-surface comprising a table.

14. The football fan officiating system of claim 12 wherein holding-tee comprises said light-weight plastic material for stability during use.

15. The football fan officiating system of claim 1 wherein said game-instructions comprises a booklet able to be stored within said flag-container having said top-half and said bottom-half when not in use.

16. The football fan officiating system of claim 15 wherein said booklet of said game-instructions is removed from said bottom-half when in use and available for said users for said duration of said football-game.

17. The football fan officiating system of claim 15 wherein said game-instructions comprises officiating duties for a professional football official and professional football regulations.

18. A football fan officiating system comprising:

a football-fan-officiating-assembly comprising;

a flag-container having a top-half and a bottom-half;

a plurality-of-flags; and a holding-tee; and game-instructions;

wherein said football fan officiating system comprises said football-fan-officiating-assembly and said game-instructions;

wherein said football-fan-officiating-assembly comprises in combination said flag-container having said top-half and said bottom-half, said plurality-of-flags, and said holding-tee;

wherein said flag-container having a top-half and a bottom-half comprises light-weight plastic material for durability in use;

wherein said top-half comprises a bottom-edge able to be removably fitted into a top-edge of said bottom-half;

wherein when said bottom-edge and said top-edge are removably-fitted together forming a coupling, said coupling comprising a smooth-surface;

wherein said flag-container having said top-half and said bottom-half comprises a full-volume when fitted together;

wherein said top-half and said bottom-half are able to be removably fitted together to form a structured and arranged complete-football when assembled;

wherein said complete-football is hollow and able to concealably contain said plurality-of-flags when not in use;

wherein said flag-container having said top-half and said bottom-half comprises indicia of one of various professional football teams;

wherein said flag-container having said top-half and said bottom-half comprises stitching and simulated-football-lacing on an outside-surface;

wherein said complete-football is able to be separated into said top-half and bottom when in use with said bottom-half holding said plurality-of-flags;

wherein said bottom-half is structured and arranged able to rest on said holding-tee when in use and users are able to access said plurality-of-flags while viewing a football-game;

wherein said plurality-of-flags comprises a quantity of said plurality-of-flags sufficient to be used by at least two users for said duration of said football-game;

wherein each of said plurality-of-flags comprises a shape of a badminton shuttlecock having a rounded-end and wings;

wherein each of said plurality-of-flags comprises thin material able to aerodynamically slice through air as it is thrown;

wherein each of said rounded-ends comprises wadding to provide weight, said weight allowing said plurality-of-flags to be tossed by a user to said planer-surface comprising a floor;

wherein said holding-tee comprises said light-weight plastic material for stability during use;

wherein said holding-tee comprises a flat hollow square able to hold a tip of said bottom-half of said flag-container;

wherein said holding-tee further comprises a leg at each corner of said flat-hollow-square, said legs able to hold said flat-hollow-square above said planer-surface comprising a table;

wherein said game-instructions comprises a booket able to be stored within said flag-container having said top-half and said bottom-half when not in use;

wherein said booklet of said game-instructions is removed from said bottom-half when in use and available for said users for said duration of said football-game;

wherein said game-instructions comprises officiating duties for a professional football official and professional football regulations;

wherein said users are able to watch said football-game; and wherein when said users see an infraction for said duration of said football-game according to said game-instructions, said users are able to retrieve one of said plurality-of-flags from said bottom-half and toss one of said plurality-of-flags to said planer-surface to indicate that said user is calling a penalty on at least one of players participating in said football-game.

19. The football fan officiating system of claim 18 further comprising a kit including: said football-fan-officiating-assembly including said complete-football, said plurality-of-flags, and game-instructions, and use instructions.

* * * * *